US005451298A

United States Patent [19]

Ueffinger

[11] Patent Number: 5,451,298

[45] Date of Patent: Sep. 19, 1995

[54] METHOD AND DEVICE FOR THE ELECTROLYTIC RECOVERY OF SILVER IN TWO FILM PROCESSING MACHINES

[75] Inventor: Gerhard Ueffinger, Weinstadt-Grossheppach, Germany

[73] Assignee: Eastman Kodak Company, Rochester, N.Y.

[21] Appl. No.: 239,107

[22] Filed: May 6, 1994

[30] Foreign Application Priority Data

May 8, 1993 [DE] Germany ..... 43 15 434.4

[51] Int. Cl.[6] ..... C25C 1/20

[52] U.S. Cl. ..... 204/109

[58] Field of Search ..... 204/109, 149, 409, 275; 73/61.62, 61.41

[56] References Cited

U.S. PATENT DOCUMENTS 3,964,990 6/1976 Woyden ..... 204/275
4,362,608 12/1982 Biles et al. ..... 204/109
4,834,850 5/1989 de Nora et al. ..... 204/109

FOREIGN PATENT DOCUMENTS

418757A2 3/1991 European Pat. Off. .

OTHER PUBLICATIONS

Propectus of H. Stamm KG Company/1991.

*Primary Examiner*—John Niebling
*Assistant Examiner*—Brendan Mee
*Attorney, Agent, or Firm*—John R. Everett

[57] ABSTRACT

A method for the electrolytic recovery of silver is disclosed. The silver is recovered from two film processing machines. Each machine has a fixing bath. Silver concentration is determined in each bath by an electrolysis cell of a silver recovery unit The silver concentration is used for connecting the fixing baths. The method comprises the steps of:

a) initially establishing a flow connection, within a predetermined period of time, between the silver recovery unit and one of the fixing baths by a valve arrangement,
b) measuring a value required for determining silver concentration during the period,
c) establishing the flow connection after the predetermined period of time with the other fixing bath,
d) measuring the value required for determining the silver concentration during the connection period with the fixing bath in e),
e) comparing the determined silver concentrations,
f) coupling, according to the determination of step e), the fixing bath having the higher silver concentration to the silver recovery unit,
g) switching on of the electrolytic current of the silver recovery unit when an upper predetermined silver concentration value has been reached,
h) maintaining the flow connection with the silver recovery unit until the silver concentration has dropped below a lower predetermined silver concentration value, and
i) establishing the flow connection with the other fixing bath and repeating the above steps e) to i).

3 Claims, 1 Drawing Sheet

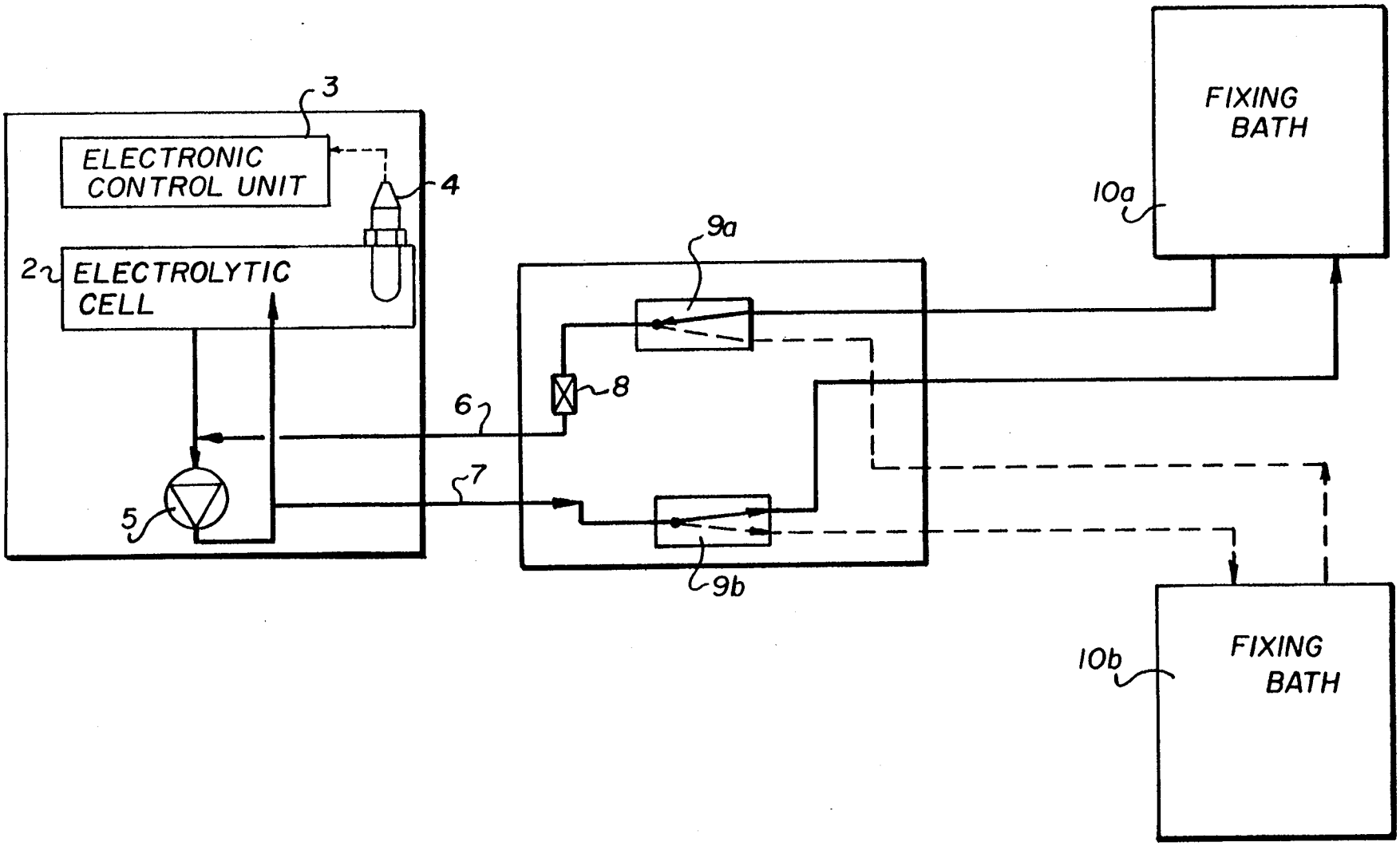
FIXING BATH
10a
FIXING BATH
10b
9a
9b
8
6
7
4
3
ELECTRONIC CONTROL UNIT
ELECTROLYTIC CELL
2
5

METHOD AND DEVICE FOR THE ELECTROLYTIC RECOVERY OF SILVER IN TWO FILM PROCESSING MACHINES

FIELD OF THE INVENTION

The invention relates to a method and a device for the electrolytic recovery of silver in two film processing machines wherein, according to the method, the silver concentration in the electrolysis cell of a silver recovery unit is determined by measuring of a value deducible from such silver concentration and is used for connecting said processing machines.

BACKGROUND OF THE INVENTION

Several methods are known for determining from measuring values the silver concentration in fixing baths of film processing machines.

For controlling electrolysis cells, for example, the voltage potentials are measured via a cell anode and cathode, said potentials being more or less proportional to the silver concentration. Also known is the measuring of the conductivity of the fixing solution by means of conductivity sensors. In EP-O 418 757 A2, for example, it is proposed that the supply of replenisher solution for two fixing baths from two supply tanks be controlled by means of a single conductivity sensor.

BRIEF DESCRIPTION OF THE DRAWINGS

The sole FIGURE is a schematic representation of the method of this invention.

The silver concentration can be determined with a considerably higher degree of precision by means of measuring electrodes which consist of a reference electrode, such as an Ag/AgCl electrode or the like and a measuring electrode, between which the potential is measured.

SUMMARY OF THE INVENTION

The application of one of such methods is known for example from an on-line fixing bath replenishing system to which one to three processing machines can be connected, the fixing bath solutions being continuously supplied through connecting lines to an electrolytic desilvering unit where they are desilvered before being returned into the baths (prospectus of H. Stamm KG company/1991).

The electrolysis current is controlled in a manner known per se by signals corresponding to the silver concentration value of the liquid mixture formed in the recovery unit. That value is either directly measured by sensors arranged in said unit or determined via the film lengths and widths passing through said fixing baths.

In a comparable manner, a fixing bath can be replenished using an on-line "Ecosys F 08" unit offered by Agfa-Gevaert AG for two processing machines.

The above method is disadvantageous in that the desilvering of each individual fixing bath is not carried out in accordance with the amount of silver introduced into the bath and corresponding to the film lengths and widths passed through each bath. Optimum desilvering of each individual fixing bath according to its actual silver concentration is not feasible therefore.

Another disadvantage of this method is that if the amounts of silver introduced into the fixing baths differ considerably a liquid mixture is formed within the silver recovery unit whose total silver concentration is lower than the concentration of that one of the fixing baths whose film through-put is higher. Since, with the electrolysis currents held equal, higher silver recovery rates can be obtained with higher silver concentrations than with lower concentrations such methods do not allow silver to be recovered from the fixing liquid with optimum speed.

It is therefore an object of the invention to provide a method and a device for the electrolytic silver recovery in two film processing machines, which require a minimum of apparatus means and allow the fixing baths to be connected to a silver recovery unit in response to the silver concentration and desilvering loss to be minimized.

According to the invention this object is attained in that within predefinable periods of time and with the aid of setting means, the silver recovery unit is alternately brought into flow connection with either one or the other of the fixing baths and in that during said connecting period, the values required for determining the silver concentration are measured by electronic means and compared such that the fixing bath having the higher silver concentration is coupled to the silver recovery unit. After a predetermined silver concentration value has been reached in one of the fixing baths the flow connection with the silver recovery unit is maintained until the predetermined silver concentration has been reduced by the action of the electrolysis current or until after a temporary connection of the other of the fixing baths it has been ascertained that the silver concentration of the other bath is higher, in which case that other bath remains connected.

When the desilvering of a fixing bath is terminated in that the predetermined silver concentration has been reached the silver recovery unit is connected with the second fixing bath by setting means.

Predefinable periods of time for alternately connecting one of the fixing baths to the silver recovery unit are a function of the level of change in the measuring values resulting for each fixing bath from the values measured. This advantageously allows the silver recovery unit to be connected in a timed relationship to the amounts of silver introduced into the fixing baths.

The method is carried out using a sensor for determining a measuring value deducible from the silver concentration, a supply and return duct for establishing flow connections between the fixing baths and the silver recovery unit as well as a valve arrangement which in accordance with the invention includes a valve each in the supply and the return duct, said valves being electronically set for alternately connecting one or the other of the fixing baths with the silver recovery unit.

The sensor used for measuring the silver concentration is a combined measuring and reference electrode advantageously arranged in the electrolysis cell or/and in one of the ducts between the circulating pump and the valves or in the circulation system.

The invention will be explained in further detail with reference to the single FIGURE which schematically illustrates the device for carrying out the method according to the invention.

A silver recovery unit 1 includes an electrolysis cell 2 which is preferably provided with a sensor 4 for determining a measuring value deducible from the silver concentration, an electronic control unit 3 as well as a circulating pump 5. Sensor 4 represents a combined electrode in which for example an ion-selective electrode and a reference electrode are arranged in a single shank.

In order to establish a flow connection between the silver recovery unit and the fixing baths 10*a* and 10*b* of two film processing machines not illustrated a supply duct 6 is provided for supplying liquid to the electrolysis cell 2, and a return duct 7 for transporting liquid away from cell 2, both ducts including switchable closing and opening valves 9*a* and 9*b*. In supply duct 6, a flow meter 8 is arranged which controls the liquid exchange caused by circulating pump 5 between electrolysis cell 2 and the fixing bath 10*a* or 10*b* connected to it.

The FIGURE does not show the electric connections of the control unit 3 which controls the valves 9*a* and 9*b* and transmits the signals generated by sensor 4 by means of which the amounts of silver introduced into the fixing baths can be determined.

The method according to the invention can be described as follows:

When circulating pump 5 has been switched on the fixing baths 10*a* and 10*b* and the electrolysis cell 2 initially contain a silver free fixing solution, with cell 2 of silver recovery unit 1 being connected to one of the fixing baths, for example bath 10*a*, through valves 9*a* and 9*b* switched in an appropriate manner. When a film is supplied to this fixing bath, a period of time such as 15 minutes is preset by means of control unit 3 and the potential at sensor 4 is measured over said period. On the basis of the known dependency of said potential on the silver concentration the silver concentration is computed by control unit 3 and stored. After the predefined period of time, unit 3 generates a signal which causes the valves 9*a* and 9*b* to be set such that fixing bath 10*b* is once again coupled to electrolysis cell 2.

In order to ascertain whether the silver concentration in fixing bath 10*b* is higher than that in bath 10*a* a further potential measurement on sensor 4 is made during a period of, e.g. 15 seconds which is also predefinable by control unit 3. This value corresponding to the silver concentration in fixing bath 10*b* is compared in control unit 3 with the silver concentration value determined in fixing bath 10*a*. If the potential changes in the direction towards a lower silver concentration, i.e. if less silver was introduced into fixing bath 10*b*, control unit 3 causes a signal to be formed by which the valves 9*a* and 9*b* are switched such that fixing bath 10*a* is once again connected to electrolysis cell 2.

If in the case of the aforementioned connection of cell 2 with fixing bath 10*b*, there is no increase in the silver concentration or if an increase in the silver concentration is determined through the change in potential, i.e. the same or a higher amount of silver is introduced into fixing bath 10*b*, this connection is maintained for the predefined period of 15 minutes.

At the end of the 15-minute period the process is repeated as described.

Due to the repeated connection of the electrolysis cell to the fixing baths, the changes in the silver concentrations in the fixing baths 10*a*, 10*b* occurring in the meantime can be derived from the values stored in control unit 3 so that measuring and switch-over between the fixing baths is no longer brought about on the basis of the predefinable period of 15 minutes but within a period of time corresponding to the actual change in the silver concentration.

If there is a silver concentration value of, e.g. 0.25 g silver/liter, which is also predefinable by control unit 3, the electrolysis current is switched on for the desilvering of the fixing solution, said current being effective until the value in one of the systems, e.g. fixing bath 10*a* coupled with electrolysis cell 2, has dropped below the predefined level. If the value of 0.25 g silver/liter is reached by desilvering, the system is automatically switched over so that the other of the two fixing baths is coupled to the electrolysis cell 2 of silver recovery unit 1.

For measuring a value corresponding to the silver concentration, sensor 4 can also be advantageously arranged in the circulation system 11 or in one of the ducts 6 or 7.

The method according to the invention not only allows the fixing baths to be connected to the electrolysis cell of a silver recovery unit in response to the silver concentration but also permits the temperature of the fixing liquid to be maintained by circulation in the entire system if there are long shut-down periods caused by low amounts of silver introduced into the fixing baths.

I claim:

1. Method for the electrolytic recovery of silver in two film processing machines each having a fixing bath wherein the silver concentration in the electrolysis cell of a silver recovery unit is determined by measuring of a value indicative of the silver concentration and is used for connecting said fixing baths, characterized by the steps of:

a) initially establishing a flow connection for a predetermined period of time between the silver recovery unit and one of the fixing baths by a valve arrangement, b) measuring the value required for determining the silver concentration during a connection period, c) establishing said flow connection after said predetermined period of time with the other of said fixing bath, d) measuring the value required for determining the silver concentration during a connection period with said other fixing bath, e) comparing said determined silver concentrations, f) coupling, according to the determination of step e), the fixing bath having the higher silver concentration to the silver recovery unit, g) switching on of the electrolytic current of said silver recovery unit when said coupled fixing bath has reached an upper predetermined silver concentration value, h) maintaining the flow connection with the silver recovery unit until the silver concentration has dropped below a lower predetermined silver concentration value, and i) establishing said flow connection with the other fixing bath and repeating the above steps e) to i).

2. Method according to claim 1, characterized in that the fixer solution permanently circulates during said flow connection between said silver recovery unit and the fixing bath which has been coupled.

3. Method according to claim 1, characterized in that said upper predetermined silver concentration value is defined by 0.25 gram of silver per liter for switching on the electrolytic current and said lower predetermined silver concentration value is defined by 0.20 gram of silver per liter for switching off the electrolytic current of said silver recovery unit.

* * * * *